United States Patent [19]

Morel

[11] Patent Number: 4,481,228

[45] Date of Patent: Nov. 6, 1984

[54] ELECTROSTATIC PAINTING METHOD AND APPARATUS

[75] Inventor: Jean Morel, Grenoble, France

[73] Assignee: Sames, S.A., Meylan, France

[21] Appl. No.: 367,884

[22] Filed: Apr. 13, 1982

[30] Foreign Application Priority Data

Apr. 17, 1981 [FR] France ..... 81 07810

[51] Int. Cl.[3] ..... B05D 1/04; B05D 5/02; B05D 1/28

[52] U.S. Cl. ..... 427/31; 427/33; 118/626; 118/632; 239/297; 239/300; 239/700

[58] Field of Search ..... 427/31, 33, 425; 118/626, 631, 632; 239/3, 700, 701, 702, 703, 290, 300, 297, 299

[56] References Cited

U.S. PATENT DOCUMENTS 2,878,143 3/1959 Juvinall ..... 117/93
2,884,341 4/1959 Juvinall ..... 427/31

FOREIGN PATENT DOCUMENTS 2336183 7/1977 France .

*Primary Examiner*—Norman Morgenstern
*Assistant Examiner*—K. E. Jaconetty
*Attorney, Agent, or Firm*—Sandler & Greenblum

[57] ABSTRACT

A paint sprayer is disposed substantially on the axis of an almost closed (omega-shaped) loop formed by a transporter. Its axis of rotation is aligned so that the area in which the sheet of atomized paint it produces intersects the cylinder defined by the axes of the objects to be painted lies in an area contained between but reaching as far as circles delimiting the part-cyclindrical surface over which the objects move. An annular nozzle connected to a source of pressurized gas is disposed behind a rotating bowl of the sprayer so that an annular gas jet is directed onto the initial part of the thin sheet of atomized paint. The pressure of the gas fed to this nozzle is modulated periodically so that the aforementioned intersection area reaches the delimiting circles alternately and periodically.

14 Claims, 11 Drawing Figures

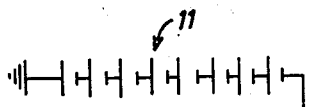
FIG. 1
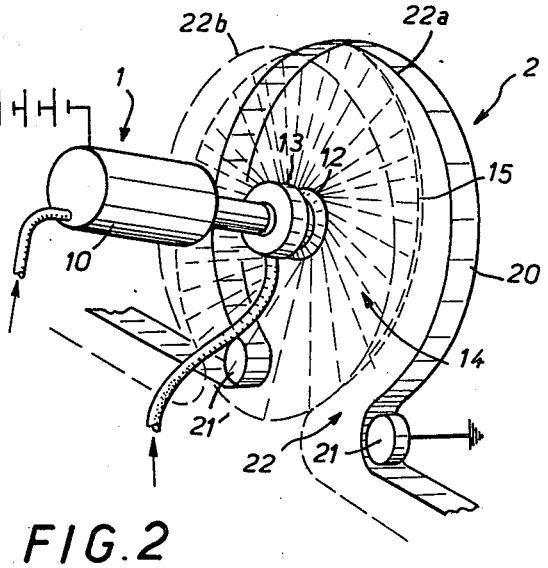
FIG. 2
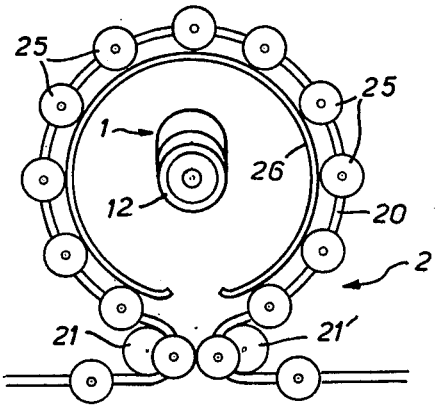
FIG. 3
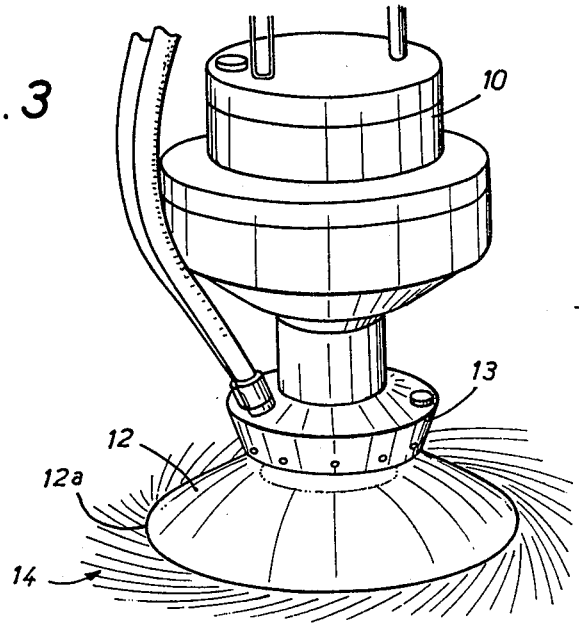
FIG. 4
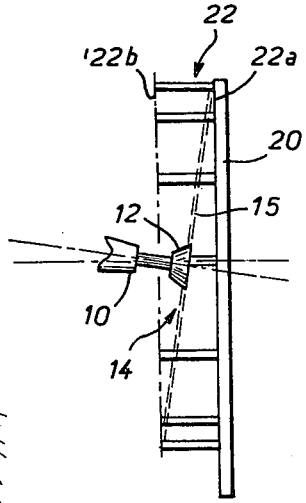

ELECTROSTATIC PAINTING METHOD AND APPARATUS

BACKGROUND OF THE INVENTION

1. Field of the Invention

The invention concerns an electrostatic method and apparatus for painting small elongate objects which extend along a principal axis, in which the objects are passed along a transporter forming a loop which is almost closed, while rotating around their respective axes, a rotating bowl sprayer being disposed substantially on the axis of the loop so as to direct paint onto the objects.

2. Description of the Prior Art

Rotating bowl electrostatic sprayers direct a thin sheet of atomized paint, contained between two conical surfaces with almost the same angle at the apex, from the edge of a component rotating at high speed, onto the surface of which the paint is deposited. The distance separating the sprayer from the objects to be painted is of the order of a few decimeters.

In painting objects with small dimensions, that is to say with dimensions less than the distance of the objects from the sprayer, it will be clear that the cost-effectiveness of the operation is dependent on the objects being presented while moving in such a way as to intercept a substantial portion of the sheet of atomized paint. Moreover, if the objects extend along a principal axis, it is preferable to rotate them around this axis so as to obtain a regular thickness over their periphery, and to present this principal axis substantially perpendicular to the sheet of paint so that the components holding the objects are protected from the paint. The solution generally adopted consists in the use of a transporter forming a loop, which is almost closed, around a horizontal axis. On this the objects are mounted with their principal axis parallel to the axis of the loop and so as to rotate several times on their own axes while moving around the loop. The sprayer is disposed with the bowl on the axis of the loop so that the distance to the objects is constant. The objects move around the sprayer on a part-cylindrical surface delimited by two circles coaxial with the loop, traced out by respective ends of the principal axes of the objects. The axis of rotation of the sprayer bowl is at an angle to the axis of the loop, however, so that the area in which the part-cylindrical surface defined by the axes of the objects and the sheet of atomized paint is tangential to the two circles delimiting the part-cylindrical surface over which the objects move. Thus as they move around the loop the objects may be coated with paint over their entire length. The rotation of the objects around their axes and the electrostatic force resulting from the action on the electrically charged paint particles of an electrostatic field created by a difference in potential between the rotating bowl and the objects ensures a regular deposit of paint on the periphery of the objects (as seen along the axis). However, the inclined disposition of the axis of rotation of the bowl results in excess thickness at the ends of the objects, since the rate at which the aforementioned intersection area moves along each object becomes zero at the ends, at which it is tangential to the delimiting circle, and is maximum in the center.

In practice there is no improvement in this when the sprayer is equipped with an annular nozzle behind the bowl, supplied with a gas under pressure and oriented so that the gas jets are directed onto the initial part of the sheet of paint. This sheet then assumes a generally conical shape, thickening slightly under the effect of turbulence. This arrangement, sometimes referred to as a "shower" spray, enables the sprayer to be moved back relative to the center of the part-cylindrical surface. The differences in thickness of the paint in the longitudinal direction are not reduced by this measure, however, as in addition to the excess thicknesses at the ends there is then a lack of symmetry relative to the center of the object.

Some objects may be of a shape such that a variation of the quantity of paint deposited along the length of the object is desirable, but it is unfortunately rare for the required variation to correspond to the variation resulting from the oblique disposition of the rotation axis.

Because of the small dimensions of the objects, the period during which they are coated with paint is of limited duration. If it were required to modulate the quantities of paint sprayed by controlled displacement of the sprayer, as is common practice for coating certain large objects, it would be necessary for the period of such displacement to be short relative to the total coating duration, so as to affect all objects uniformly. The corresponding control system would be complex, expensive and difficult to adjust.

An objective of the invention is to provide an electrostatic method for painting small objects in such a way that the longitudinal distribution of paint is regular.

Another objective of the invention is to provide an electrostatic method for painting small objects wherein the longitudinal distribution of paint may be modulated in a relatively simple manner.

SUMMARY OF THE INVENTION

The invention consists in an electrostatic method for painting small elongated objects which extend along a principal axis wherein said objects are disposed on respective individual rotary supports of a transporter forming a loop which is almost closed and the axis of which is parallel to the rotation axes of said supports, whereby said objects rotate about their respective axes and also move over a part-cylindrical surface delimited by two circles coaxial with said loop, around a paint sprayer comprising a bowl which is rotated at high speed and maintained at a high voltage relative to said transporter, producing a thin sheet of atomized paint substantially in the form of a body of revolution about the rotation axis of said bowl, which is disposed substantially on the axis of said loop with its axis of rotation aligned so that the area in which said sheet of atomized paint intersects the cylinder defined by the axes of said objects is contained between but reaches as far as said circles delimiting said part-cylindrical surface, said sprayer being equipped with an annular nozzle connected in use to a source of pressurized gas and disposed behind said bowl so that an annular gas jet is directed onto the initial part of said thin sheet of atomized paint, and the feed pressure of said pressurized gas being modulated periodically so that said intersection area reaches said delimiting circles alternately and periodically.

The effect of the modulation of the feed pressure is a modulation of the cone at the apex of the sheet of paint, which reacts with reduced inertia. The effect at the part-cylindrical surface is as if the sprayer were subject to alternating axial movement. Note that in addition to displacement of the area in which the part-cylindrical surface intersects the sheet of atomized paint, the action of the jet of air from the nozzle on the sheet of paint creates turbulence which thickens the sheet.

The annular nozzle is preferably connected to said source of pressurized gas periodically. In this way "on/-off" modulation is obtained in a remarkably simple manner.

Alternatively, the annular nozzle may be connected continuously to one pressurized source and periodically to a source of higher pressure. This results in "high/-low" modulation which not only authorizes rearward displacement of the sprayer but also produces a sheet of paint which is thickened by turbulence at all times.

A further possibility is to divide the nozzle into sectors, each of which is fed with gas at a respective pressure. Each sector defines a partial intersection area in which the scanning conditions are independent of those in the other areas. Among other things, this permits preferential coverage to be given to certain parts of the objects.

The invention further consists in apparatus for electrostatically painting small elongate objects which extend along a principal axis, comprising a transporter forming a loop around an axis and which is almost closed, rotary supports for said objects on said transporter, having their rotation axes parallel to said axis of said loop, whereby said objects rotate about their respective axes and also move over a part-cylindrical surface delimited by two circles coaxial with said loop as they move around said loop, a paint sprayer comprising a bowl which is rotated at high speed, producing a thin sheet of atomized paint substantially in the form of a body of revolution about the rotation axis of said bowl, which is disposed substantially on the axis of said loop with its axis of rotation aligned so that the area in which said sheet of atomized paint intersects the cylinder defined by the axes of said objects is contained between but reaches as far as said circles delimiting said part-cylindrical surface, said sprayer further comprising an annular nozzle for connection when in use to a source of pressurized gas, said nozzle being disposed behind said bowl so that, in use, an annular gas jet is directed onto the initial part of said thin sheet of atomized paint, said apparatus further comprising means for maintaining said bowl at a high voltage relative to said transporter and means whereby the feed pressure of said pressurized gas is modulated periodically so that said intersection area reaches said delimiting circles alternately and periodically.

Other objects and advantages will appear from the following description of an example of the invention, when considered in connection with the accompanying drawings, and the novel features will be particularly pointed out in the appended claims.

BRIEF DESCRIPTION OF THE DRAWINGS

FIG. 1 is a perspective view of apparatus suitable for the implementation of the invention.

FIG. 2 is a diagram showing the end view of a transporter forming a loop in the shape of the Greek letter omega.

FIG. 3 is a more detailed view of a rotating bowl sprayer.

FIG. 4 is a schematic showing in side elevation use of the apparatus shown in FIG. 1 in a manner known in the art.

DESCRIPTION OF THE PREFERRED EMBODIMENT

Figure 5:
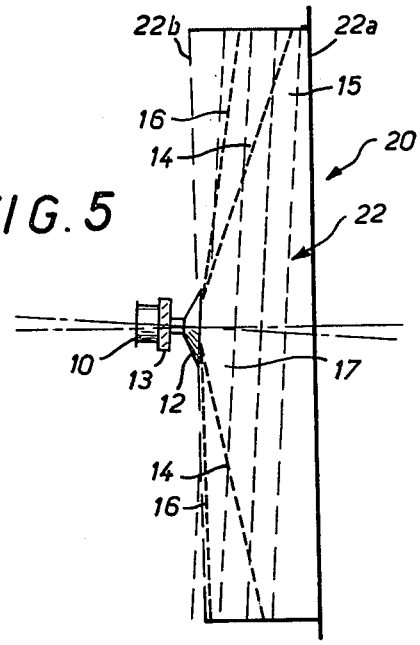
FIG. 5 is a schematic showing in side elevation use of the apparatus shown in FIG. 1 in a manner in accordance with the invention.

The apparatus known per se in the art and shown in FIGS. 1 to 4 comprises an electrostatic sprayer 1 including a rotating bowl 12, disposed substantially on the axis of a loop 20 formed by a transporter 2. Sprayer 1 is maintained at a high potential relative to transporter 2, which is earthed, by a high voltage source 11, and incorporates a turbine enclosed within body 10 for rotating bowl 12 at high speed (up to 60,000 revolutions per minute). The internal surface of bowl 12 is substantially frusto-conical, and paint injected onto this surface is directed towards the edge **12*a* of the bowl, whence it is projected tangentially in the form of a sheet 14 of atomized paint. At the base of bowl 12, between the bowl and turbine body 10, is disposed an annular nozzle 13 supplied with compressed air and formed with outlet orifices which direct jets of air onto the external surface of bowl 12. These air jets, initially provided primarily to prevent atomized paint reaching sprayer body 10, distort sheet 14 of atomized paint so that it changes from a plane to a cone with a very large half-angle at the apex. FIG. 4 shows sheet 14** as seen from the edge, in the plane form.

Transporter 2 comprises a part-circular loop 20 which is almost closed, being in the general shape of the uppercase Greek letter omega. The transporter passes from the horizontal section into loop 20 around rollers 21 and 21', which thus define the inlet and outlet ends of loop 20, respectively. The transporter comprises supports for the objects, extending cantilever fashion parallel to the axis of loop 20. As shown in FIG. 2, these supports have at their rear ends wheels 25 which bear on a rail 26 concentric with loop 20, so that as they move around the loop the objects are caused to rotate around the support axis. The apparatus shown is used for painting objects which are of small dimensions as compared with the normal distance between the objects and bowl 12, corresponding in practical terms to the radius of loop 20. The objects extend along a principal axis which coincides with the axis of the support, this principal axis being that extending along the longest dimension of the object. Their dimensions in directions orthogonal to one another and to the principal axis are significantly smaller than this longest dimension.

Thus the support axes define a part-cylindrical surface coaxial with loop 20, and the main axes of the objects move over a section 22 of this part-cylindrical surface, delimited by two circles **22*a* and 22*b* coaxial with loop 20**.

This being the case, the objects will receive atomized paint essentially in the area 15 in which part-cylindrical surface 22 is intersected by sheet 14. As shown in FIG. 1 and more clearly in FIG. 4, this area 15 is tangential on one side to delimiting circle 22*a* and on the other side to delimiting circle 22*b*, so that the objects receive paint over their entire length, while their rotation around the principal axis ensures peripheral coverage.

In order that area 15 should be tangential to delimiting circles 22*a* and 22*b*, the axis of rotation of bowl 12 is inclined relative to the axis of loop 20, as shown clearly in FIG. 4. When developed, area 15 is of sinusoidal form tangential to the straight lines representing the developments of delimiting circles 22*a* and 22*b*. The shape of area 15 will be only slightly affected by distortion of sheet 14 to a conical form under the effect of the air blown out by nozzle 13, in that, as will be understood, bowl 12 would be moved back relative to the axis of loop 20 in order to maintain area 15 between delimiting circles 22*a* and 22*b*.

Given that the transporter runs at constant speed, the geometrical development of area 15 corresponds to the timing diagram for "scanning" of each object by the sheet of atomized paint, the developed length corresponding to the total time of exposure of the object to the paint. As the developed form is at least approximately sinusoidal, the scanning speed is zero at the ends of the object and maximum in the center. In spite of corrections provided by the thickness of sheet 14 and by the presence of the electrostatic field, the paint deposited on the objects is of excess thickness at the ends.

FIG. 5 illustrates the process whereby the invention overcomes this shortcoming. FIG. 5 shows again, in schematic form, scanner body 10, rotating bowl 12, annular nozzle 13, transporter loop 20 and the part-cylindrical surface 22 defined by the principal axes of the objects and contained between delimiting circles 22*a* and 22*b*. The angle between the axes of loop 20 and rotating bowl 12 has been reduced with the result that the area in which the sheet of paint and part-cylindrical surface 22 intersect covers only approximately half the length, in the axial direction, of the part-cylindrical surface. A first discharge pressure from nozzle 13 is defined so that area 15 in which sheet 14 intersects part-cylindrical surface 22 is tangential to delimiting circle 22*a*. A second discharge pressure from nozzle 13 is defined so that area 17 in which sheet 16 intersects part-cylindrical surface 22 is tangential to delimiting circle 22*b*. It will be understood that the second pressure is less than the first, so that the angle at the apex of conical sheet 16 is less than that for conical sheet 14.

To coat the objects with paint, nozzle 13 is fed alternately at the first and at the second pressure defined as explained above, the period of alternation being short as compared with the period for an object to pass around loop 20. The pressure waveform is shown in line 40 of FIG. 7, on which levels 41 and 42 represent the first and second pressure values, respectively. The strip 122 represents the developed part-cylindrical surface 22, whereas lines 122*a* and 122*b* are respectively the developments of delimiting circles 22*a* and 22*b*. The area 115 is the development of the intersection area, alternately 15 and 17, as "seen" by an object passing around loop 20. Area 115 is the result of the super-position of two harmonic movements, one at the period defined by the movement of an object and the other at the period of alternation between the first and second pressures. It can be clearly seen, even without an in-depth analysis of the distribution, that the excess thicknesses at the ends are attenuated and that the distribution along the length of the object is substantially regular.

To give typical orders of magnitude, the diameter of loop 20 is approximately 0.5 m and the linear speed of transporter 2 is 10 meters per minute, so that an object passes around the loop in approximately 9 seconds. Each object rotates between nine and ten times as it passes around the loop, that is to say it rotates at a rate of one revolution per second. The diameter of bowl 12 is approximately 70 mm and the voltage produced by high-tension generator 11 is approximately 90 kV.

The first pressure is approximately 3 bars and the second pressure approximately 1 bar. The pulses of the first pressure last 0.25 seconds and repeat at intervals of half a second.

Figure 6:
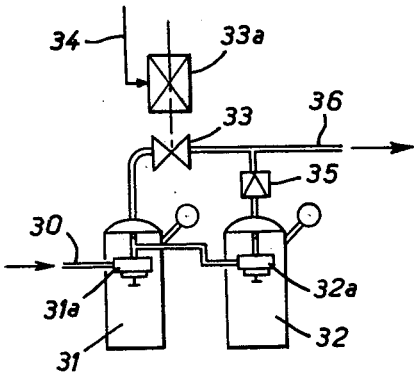
FIG. 6 is a schematic showing an arrangement for feeding pressurized gas to a nozzle of the sprayer, with "high/low" modulation of the pressure.
Figure 7:
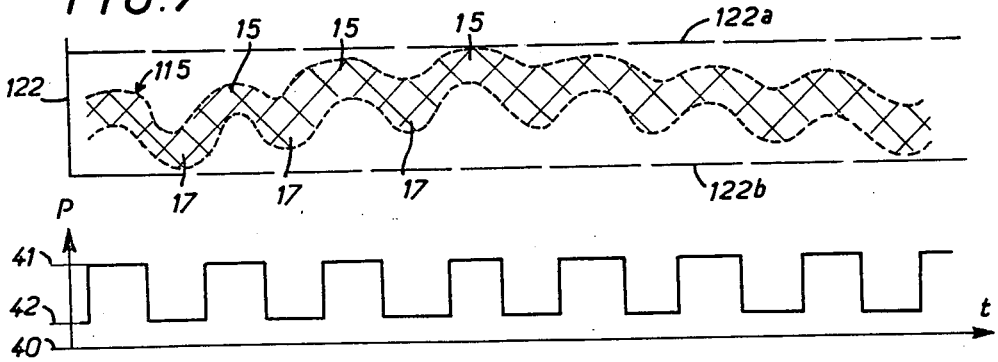
FIG. 7 is a diagram showing the distribution of paint over an object, with "high/low" pressure modulation.

The arrangement shown in FIG. 6 may be used to obtain the alternating pressure as shown by line 40 in FIG. 7. A source of compressed air is connected to an inlet pipe 30. A first air reservoir 31 is fed from pipe 30, through a first pressure regulator 31*a* which is set to the first pressure. A second and similar air reservoir 32 is fed from reservoir 31, via a second pressure regulator 32*a*, set to the second pressure. The second reservoir 32 is connected to an outlet pipe 36 to which nozzle 13 is connected via a non-return valve 35. The first reservoir 31 is connected to outlet pipe 36 through a solenoid valve 33, the actuator coil 33*a* of which receives an appropriate signal over a line 34. Valve 33 may instead be pneumatically operated. It will be understood that, when valve 33 is closed, pipe 36 is at the same pressure as reservoir 32, whereas when valve 33 is open the pressure in pipe 36 is the same as in reservoir 31. At this time valve 35 opposes air at the first pressure entering reservoir 32.

Notice that a substantially equivalent result would be obtained if the second pressure were atmospheric pressure, in other words if nozzle 13 were fed with pressure pulses separated by intervals during which the relative pressure is zero, provided of course that the sprayer with rotating bowl 20 were moved forward. This would mean that the rear part of the intersection area would be less wide, however.

Figure 8:
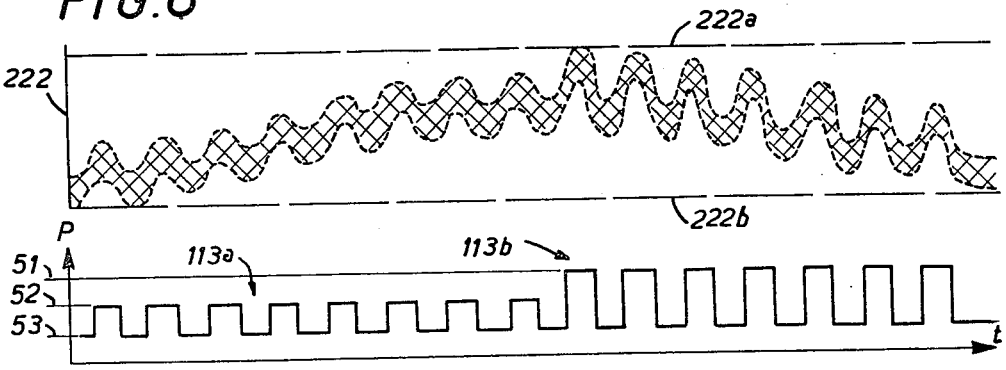
FIG. 8 is a diagram analagous to that of FIG. 7, but corresponding to a nozzle with two sectors.

The process which has just been described and discussed permits regularization of the distribution of paint along the principal axis of the objects. In some cases certain regions of the object may need to receive a greater quantity of paint (an area in which the average diameter of the object is larger, for example). To overcome this problem, pulses of different pressures may be applied with the appropriate sequences. It is also possible to use a nozzle divided into sectors each covering a certain angle around the axis of bowl 12, a specific modulated pressure being applied to each sector. This arrangement facilitates adjustments. The diagrams in FIG. 8 refer to a nozzle 13 with two sectors 113*a* and 113*b*, placed to either side of a vertical plane passing through the axis of the rotating bowl. To sector 113*a* are applied pulses of pressure varying between levels 52 and 53, whereas the pulses applied to sector 113*b* vary between levels 51 and 53.

The development of the intersection area, within strip 222 between the developments 222*a* and 222*b* of the delimiting circles, as it is "seen" by an object in motion, corresponds to the superposition of a harmonic displacement with a period corresponding to movement along the loop and two further harmonic displacements, with the periods of the respective pressure pulses, occurring consecutively and of different amplitudes. The representation shows that the quantity of paint deposited in the region adjacent delimiter 222*a* is substantially less than the quantity of paint distributed over the remainder of the object.

Figure 9:
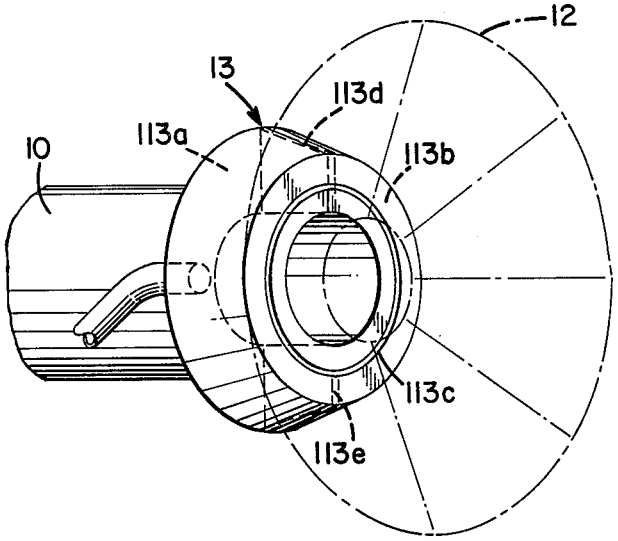
FIG. 9 illustrates a perspective front view of an annular nozzle having two sections in which the air outlet opening comprises a generally circular slit.

FIG. 9 illustrates a nozzle in the form of a toroidal shaped housing 13, on the front surface of which a generally circular slit 113*c*, is positioned in a co-axial fashion to bowl 12, which is illustrated by the dashed lines in FIG. 9. Radial partitions 113*d* and 113*e* are provided to divide the nozzle, along a vertical plane, into sections 113*a* and 113*b*.

Figure 10:
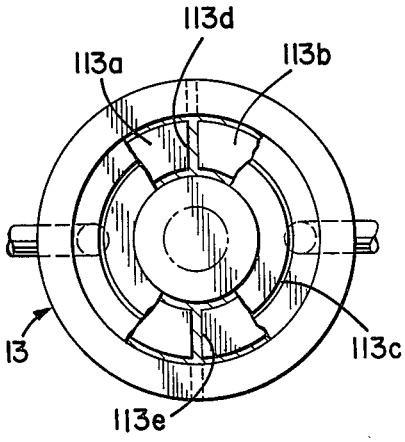
FIG. 10 is a partial cut-away front view of the annular nozzle of FIG. 9.

FIG. 10 illustrates sections 113*a* and 113*b* as each comprising a nozzle. As illustrated in FIG. 3, two conduits for feeding annular nozzle 13 are illustrated which are relatively close to one another, and which are guided to each of the sections of the nozzle.

Figure 11:
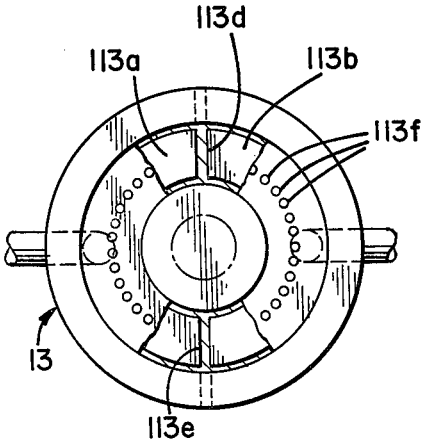
FIG. 11 is a partial cut-away front view of an annular nozzle having two sections in which the air outlet openings comprise circular holes or apertures arranged circumferentially about the nozzle.

FIG. 11 differs from FIG. 10 only insofar as the single circular slit 113*c* is replaced by a plurality of orifices 113*f* which are located circumferentially about the front surface of housing 13.

It will be appreciated that, while retaining rectangular pulse waveforms corresponding to "high/low" or "on/off" pressure modulation, it is possible to vary the pressure levels and the cyclic ratios of the pulses so as to adapt the distribution of paint along the objects to their configuration. At the same time, the oblique disposition of the rotation axis of the bowl relative to the axis of the loop provides a further adjustment parameter. It will be readily appreciated that experience and routine tests will provide for the optimum implementation of the process in accordance with the invention.

An important industrial advantage of the process resides in the saving represented by the absence of any mechanical "scanning" device.

It is claimed:

1. A method for electrostatically painting small elongate objects which extend along a principal axis wherein said objects are disposed on respective individual rotary supports of a transporter performing a loop which is almost closed, the axis of said loop being parallel to the rotation axes of said rotary supports, whereby said objects rotate about their respective axes and move over a part-cylindrical surface delimited by two circles coaxial with said loop, said objects move around a paint sprayer comprising a bowl which is rotated at high speed and maintained at a high voltage relative to said transporter, said sprayer producing a thin sheet of atomized paint substantially in the form of a body of revolution about the rotation axis of said bowl, said bowl being disposed substantially on the axis of said loop with its axis of rotation aligned so that the area in which said sheet of atomized paint intersects the cyclinder defined by the axes of said objects is contained between but reaches as far as said circles delimiting said part-cylindrical surface, comprising:

(a) providing an annular nozzle disposed behind said bowl for directing an annular jet onto said thin sheet of atomized paint; and (b) periodically modulating the feed pressure of a pressurized gas source to cause the intersection area between the paint sheet and said part-cylindrical surface to reach each said delimiting circle alternately, the period of modulation being less than the time required for said objects to pass once around said loop.

2. The method recited in claim 1 wherein said annular nozzle is periodically connected to said source of pressurized gas.

3. The method recited in claim 1 wherein said annular nozzle is periodically connected to a first source of pressurized gas and is continuously connected to a second source of pressurized gas, the outlet pressure of said second source being lower than that of said first source.

4. The method recited in claims 1 wherein said nozzle is divided into sectors each of which is fed with gas at a respective modulated pressure.

5. The method as recited in claim 1 wherein said gas jet is directed onto the inner portion of the thin sheet of atomized paint.

6. The method as recited in claim 4 wherein said sectors comprise angular sectors each covering a predetermined angle around the axis of the bowl.

7. A method in accordance with claim 1 wherein said annular nozzle includes a plurality of outlet orifices adapted to direct a plurality of gas jets onto said bowl.

8. An apparatus for electrostatically painting small elongate objects which extend along a principal axis, said apparatus comprising a transporter forming a loop around an axis, said loop being almost closed, said transporter including rotary supports for said objects, said rotary supports having their rotation axes parallel to said axis of said loop, whereby said objects rotate about their respective axes and move over a part-cylindrical surface delimited by two circles coaxial with said loop as they move around said loop, a paint sprayer comprising a bowl which is rotated at high speed, producing a thin sheet of atomized paint substantially in the form of a body of revolution about the rotation axis of said bowl, said sprayer being disposed substantially on the axis of said loop with its axis of rotation aligned so that the area in which said sheet of atomized paint intersects the cylinder defined by the axes of said objects is contained between but reaches as far as said circles delimiting said part-cylindrical surface, said sprayer further comprising:

(a) an annular nozzle for connection to a source of pressurized gas, said nozzle being disposed behind said bowl, said nozzle for directing an annular gas jet onto said thin sheet of atomized paint; and (b) means for maintaining said bowl at a high voltage relative to said transporter; and (c) means for periodically modulating the feed pressure of said pressurized gas to cause the intersection area between the paint sheet and the part-cylindrical surface to reach each said delimiting circle alternately, the period of modulation being less than the time required for the objects to pass once around the loop.

9. The apparatus recited in claim 8 wherein said annular nozzle is periodically connected to said source of pressurized gas.

10. The apparatus recited in claim 8 wherein said annular nozzle is periodically connected to a first source of pressurized gas and is continuously connected to a second source of pressurized gas, the outlet pressure of said second source being lower than that of said first source.

11. The apparatus recited in claim 8 wherein said nozzle is divided into sectors each of which is fed with gas at a respective modulated pressure.

12. The apparatus as recited in claim 8 wherein said gas jet is directed onto the inner portion of the thin sheet of atomized paint.

13. The apparatus as recited in claim 11 wherein said sectors comprise angular sectors each covering a predetermined angle around the axis of the bowl.

14. The apparatus in accordance with claim 8 wherein said annular nozzle comprises a plurality of outlet orifices which comprise means for directing a plurality of gas jets onto said bowl.

* * * * *